United States Patent [19]

Patin

[11] 4,026,558

[45] May 31, 1977

[54] WORD GAME USING LETTERED TILES

[75] Inventor: Henry A. Patin, Chicago, Ill.

[73] Assignee: Barbara J. Patin, Chicago, Ill. ; a part interest

[22] Filed: Mar. 3, 1976

[21] Appl. No.: 663,451

[52] U.S. Cl. ..... 273/137 C; 35/35 J; 35/71; 273/152.7 A

[51] Int. Cl.[2] ..... A63F 9/20

[58] Field of Search ..... 273/137 R, 137 B, 137 C, 273/137 D, 135 D, 136 W, 152.7 R, 152.7 A; 35/35 H, 35 J, 71

[56] References Cited

UNITED STATES PATENTS

| | | | |
|---|---|---|---|
| 143,703 | 10/1873 | Louineau | 273/137 C |
| 943,058 | 12/1909 | Ashenden | 273/137 C |
| 1,556,344 | 10/1925 | Phimister | 273/152.7 A |
| 1,666,448 | 4/1928 | Hardenstein | 273/137 D |
| 1,978,107 | 10/1934 | Hoffmann | 273/137 C |
| 3,053,537 | 9/1962 | Moss | 273/137 C |

FOREIGN PATENTS OR APPLICATIONS

| | | | |
|---|---|---|---|
| 5,539 | 4/1887 | United Kingdom | 273/137 D |
| 782,890 | 9/1957 | United Kingdom | 273/135 D |

*Primary Examiner*—Anton O. Oechsle
*Assistant Examiner*—Harry G. Strappello
*Attorney, Agent, or Firm*—Tilton, Fallon, Lungmus, Chestnut & Hill

[57] ABSTRACT

A word-spelling game uses a plurality of lettered tiles. The face of each tile is marked with two letters of the alphabet in such a way that each letter is recognizable as being from one of two sets. Some of the tiles are marked with two different letters, and other tiles are marked with two identical letters.

5 Claims, 12 Drawing Figures

WORD GAME USING LETTERED TILES

BACKGROUND AND SUMMARY

This invention relates to a word-spelling game which utilizes letter-bearing tiles to spell words.

Each of the tiles formed in accordance with the invention includes two letters, and each of the letters is readily distinguishable as being from one of two sets of letters. For example, the two sets of letters can be indentified by two different colors or by two different type styles. Most of the tiles are printed with two different letters, one letter from each set. However, a few of the tiles are printed with two identical letters, one of the identical letters being from one set and the other identical letter being from the other set.

DESCRIPTION OF THE DRAWING

The invention will be explained in conjunction with an illustrative embodiment shown in the accompanying drawing, in which --

FIG. 1 illustrates the four tiles which are marked with two identical letters, and FIG. 2 illustrates 28 lettered tiles which are marked with two different letters.

DESCRIPTION OF SPECIFIC EMBODIMENT

Figure 1:
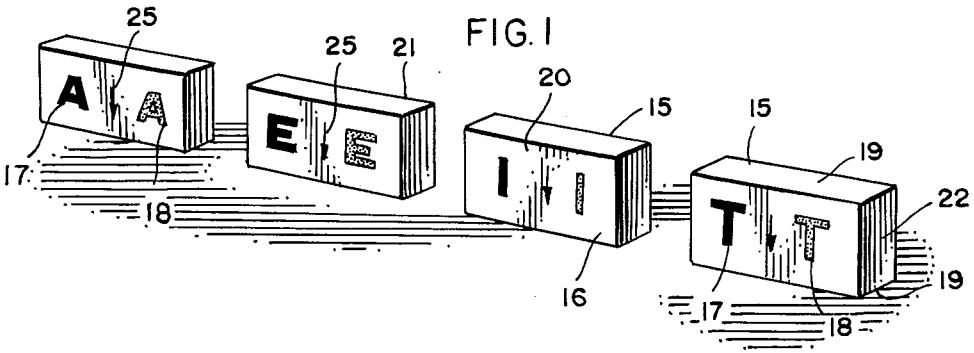
FIGS. 1 and 2 illustrate one particular game set formed in accordance with the invention which comprises 32 different lettered tiles.

One embodiment of a game made in accordance with the invention utilizes 32 rectangular tiles 15, each of which has a front flat face 16 which is marked with a dark capital letter 17 and a lighter colored capital letter 18. For example, the dark letters may be black, and the lighter colored letters may be red.

Figure 2:
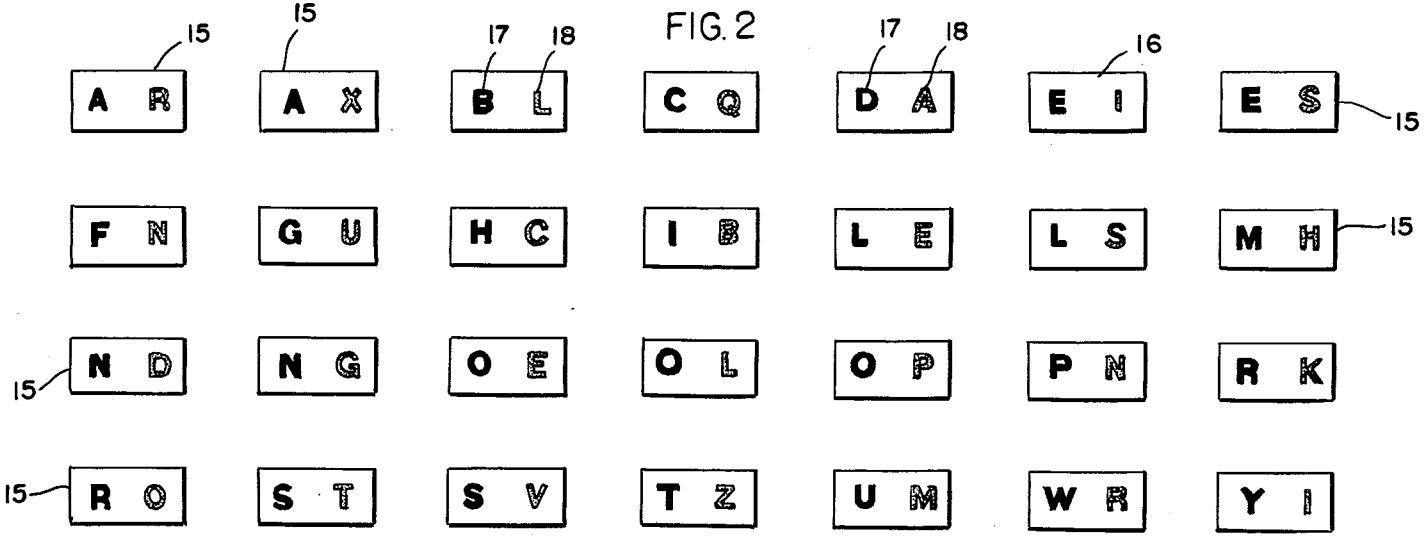

The lettered tiles 15 fall into two groups or sets, one group being shown in FIG. 1 and the other group being shown in FIG. 2. Each of the tiles in the first group are marked with two identical letters, one of the letters having the dark color and the other letter having the light color. In the embodiment illustrated, the first group of tiles comprises four double-letter tiles for the letters A, E, I, and T.

Each of the tiles of the second group include two different letters, one of the letters being dark in color and the other letter being light in color. In the specific embodiment illustrated in FIG. 2, the upper left tile includes a dark A and a light R, the next tile includes a dark A and a light X, and the third tile includes a dark B and a light L.

The dark letters of the various tiles comprise one set of letters, and the light letters of the tiles comprise a second set of letters. Briefly, the object of the game is to spell a word using letters of the same set from consecutive tiles. Although in the embodiment illustrated the two sets of letters are distinguishable by the colors of the letters, other means for distinguishing the sets of letters can be used. For example, one set of letters can be printed in upper case, and the other set of letters can be printed in lower case or in italics.

The invention can be better understood from the following four examples of specific games. Games I, II, and IV may be played by two, three, or four players, and game III is a game of solitaire. To begin any of the games, all of the tiles, except the tiles of the first group which include the double letters (hereinafter sometimes referred to as the "doubles"), are turned face down and shuffled. The doubles are placed face up so that they can be seen by all players during play. The particular tiles illustrated are rectangular cubes and include flat side surfaces 19 which extend parallel to the long dimension of the tile, flat front and back surfaces 20 and 21, and flat end surfaces 22. The base of each letter extends parallel to the long dimension of the tile. The doubles can stand upright on one of the side surfaces so that the letters are clearly visible, and when each tile is played, it can stand on its bottom flat surface 21 so that the tiles can be played in cross-directions as will be explained hereinafter.

GAME I

Figures 3, 4, 5, 6, 7, 8, 9, 10, 11, 12:
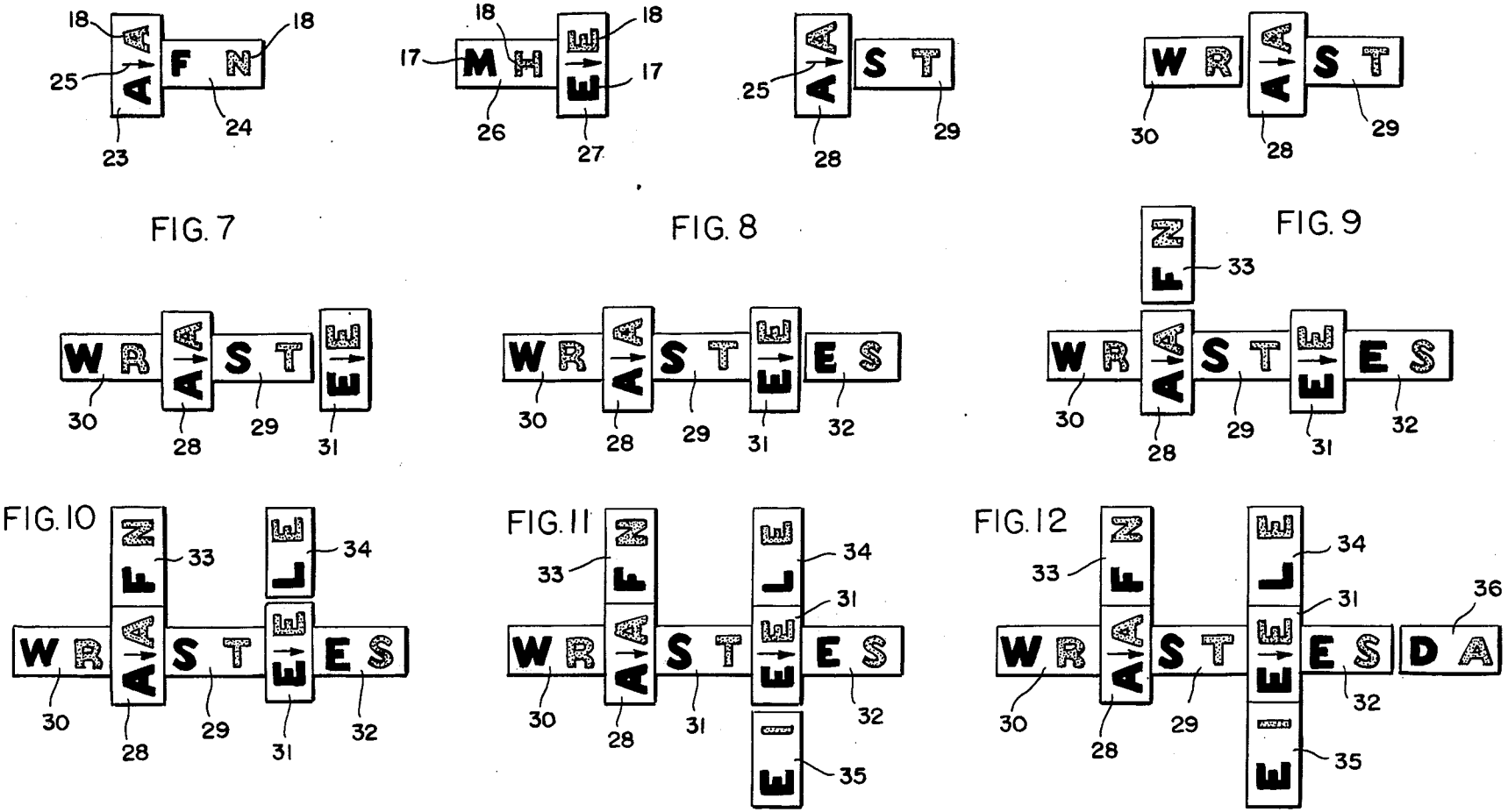
FIGS. 3–12 illustrate the placement of some of the tiles in consecutive steps of play.

This game can be played by two, three, or four players. Each player draws seven dominoes or tiles to make his hand. The first player selects a tile from his hand and also selects one of the doubles and places these two pieces together on the table face up to form a two-letter word with either the dark letters or the light letters or both. FIG. 3 illustrates a beginning play in which the word AN is spelled with the light letters 18 of a double tile 23 and a tile 24. The doubles are positioned so that the double letters thereof extend transversely with respect to the different letters of the adjacent tile of the second group. Each of the doubles is provided with an arrow 25 which indicates the direction in which words are spelled on the original line of play determined by the direction of the letters on the first tile of the second group.

FIG. 4 illustrates another beginning word in which the word ME is spelled with the dark letters 17 of the double 26 and the tile 27 and the word HE is spelled with the light letters 18.

The second player, and similarly every other player on his turn, may play one of the double-letter dominoes if it can be placed so as to contribute to spelling a word. This is a free play and may be made either before or after he plays a piece from his hand. If a player cannot spell a word, he passes and it is the next player's turn. If a player spells only words with dark letters or only words with light letters, his score for the play is the total number of letters in all the words he spells, but if he spells a word with dark letters and a word with light letters, then his score for the play is double the number of letters in all the words he spells. The score for a free play is computed separately from the score for the regualr play.

Each player computes and announces his own score after each play. After this score is entered by the scorekeeper, he may not claim points for a word which he had overlooked, but any opponent may call out the additional word (or words) and have all the points lost added to his own score.

Game is 100 points if two persons are playing and 150 points if there are three or four players. It may take two or three hands to reach game.

FIGS. 5–12 illustrate word formations on eight consecutive plays. In FIG. 5, the opening play spells the word AS with the dark letters and AT with the light letters of tiles 28 and 29. The score for the play is 8 points (4 doubled).

In FIG. 6, WAS is spelled with the dark letters of tiles 30, 28, and 29, and RAT is spelled with the light letters. Score: 12 points.

In FIG. 7, RATE is spelled with the light letters of tiles 30, 28, 29, and 31. No new word is spelled with the dark letters. Score: 4 points.

In FIG. 8, SEE is spelled with the dark letters of tiles 29, 31, and 32, and RATES is spelled with the light letters of tiles 30, 28, 29, 31, and 32. Score: 16 points.

FIG. 9 illustrates how a tile 33 of the second group can be positioned next to the double 28 to begin a new direction transverse to the original direction of play determined by the tiles 30, 29, and 32. The light letters of the tiles 28 and 33 spell the word AN. A cross line may be formed on a double, i.e., a line transverse to the direction of the arrow of the double, only after the double is enclosed by tiles on each side of the arrow.

FIG. 9 also illustrates a second method of forming words in which the letters of one color on the end tiles of each line are read in a clockwise circle. The dark letters of the end tiles 33, 32, and 30 form the word FEW when read clockwise. Since both a light-lettered word and a dark-lettered word were formed by the play illustrated in FIG. 9, the total score is 10 points (5 doubled). After a double is enclosed on both sides of its arrow, the letters of the double are not included in spelling clockwise words. For example, in FIG. 9, the letters of the doubles 28 and 31 are not considered letters of an end tile.

In FIG. 10 the tile 34 is placed to form a cross line with the double 31, and the word FLEW is spelled with the dark letters of the end tiles 33, 34, 32, and 30 read in a clockwise circle. Score: 4 points.

In FIG. 11, the word FLEE is spelled with dark letters of the end tiles 3, 34, 32, and 35 read in a clockwise circle, the word SIR is spelled with light letters of the end tiles 32, 35, and 30 read in a clockwise circle, and the word EEL is spelled with the dark letters of the tiles 35, 31, and 34 of the cross line formed by the double 31. Score: 20 points.

In FIG. 12, the word SEED is spelled with the dark letters of the tiles 29, 31, 32, and 36 extending along the original line of play, the word DEW is spelled with the dark letters of the end tiles 36, 35, and 30 read clockwise, and the word AIR is spelled with the light letters of the end tiles 36, 35, and 30 read clockwise. Score: 20 points.

GAME II

For 2, 3, or 4 players. The first player draws a tile from the shuffled pile and attempts to place it together with any one of the doubles to spell a word with either the dark letters or the light letters. If he can, he makes the play and it is the next player's turn. If he cannot play, he places the tile he drew face up on the table in front of him, and play moves to the next player. After one of the players spells the first word, each player on his turn may use one of the doubles instead of drawing a tile to make his play. Of course, if he cannot play a double, then he must draw from the pile. Whenever a player is forced to draw and is then unable to play, he places the tile he drew face up in front of him. On his next turn, instead of drawing a tile or attempting to play any remaining double, he first tries to play the tile he already has. Meanwhile, other players, wherever possible, play so as to block his opportunity to play the exposed tile. Whenever a player is able to play the tile he already has, this counts as his turn, but if he again cannot play, he must draw and play a tile from the unused pile. If he cannot play this second tile, he must drop out of the game. If he is able to play the second tile, then on his next turn he again has the opportunity to try to play the first tile.

No score is kept. The player who is left when all the others have been forced to drop out is the winner.

GAME III

For one player. The game proceeds as in Game II. The player draws a tile and attempts to use it together with a double to spell a word. Whenever a tile is drawn which cannot be played, it is retained and a second tile is drawn. If this second tile can be played, then the player can again try to play the first tile. The doubles can be played whenever the player chooses provided the double can be played whenever the player chooses provided the double contributes to spelling a word. The game is lost whenever the player has drawn two tiles which he cannot play. To win, all the tiles must be successfully played -- including all the doubles.

GAME IV

For 2, 3, or 4 players. Each player draws seven tiles from the second group. The first player selects a double and uses it with as many pieces from his hand as he chooses so as to spell a word with dark letters or with light letters. The second player similarly plays as many pieces as he wishes from his hand and he may also use one of the unplayed doubles but the word he spells must include at least one of the letters already played. The first player to play his last tile scores 10 points for each unplayed piece in his opponents' hands and 20 points for each unplayed double. Game is 150.

The tiles used for each of the foregoing games are the same. The double-lettered pieces are marked with the arrow 25 to indicate the direction in whih words are to be spelled on the line of play started by the first player. The doubles are played crosswise on this line. The other tiles, which are played end-to-end are placed so that the dark and light letters alternate. Words may be formed (1) along the original line of play started by the first player, (2) across on lines fromed by building on the crosswise doubles, or (3) in a clockwise circle, counting only the end tiles on each line. Preferably, the rules for each game should provide that clockwise-circular words must contain at least three letters.

A word may begin on any tile and may end on any tile provided that the foregoing rules are followed and that the letters forming a word are consecutive letters of the same color. Two double-lettered pieces may not be placed adjoining one another but must have at least one tile from the second group placed in between.

The number of tiles in each of the two groups and the selection and frequency of the letters imprinted on the tiles may vary. In general, the selection of letters for marking the tiles should be guided by the relative frequency of occurrence of the letters in common English words. Since the double-letter tiles add interest by allowing for greater variety in the pattern of play, the game rules should provide a device to encourage the early play of several double-letter pieces. Although the particular letters used for the double-letter tiles can be varied, I have found that the double letters shown in FIG. 1, namely, A—A, E—E, I—I, and T—T, work the best in actual practice. Further, I have found that the particular letter combinations of the tiles of the second group shown in FIG. 2 are preferred.

The material of construction of the tiles and/or the way in which the letters are applied to the tiles are not critical for the purpose of this invention. For example, the tiles may be formed of plastic, wood, cardboard, etc. The letters may be applied by printing, by decal transfer process, by being molded into the tiles, etc.

As various possible embodiments might be made of this invention, and as various modifications may be made in the embodiments above set forth, such as variation in the number of pieces in a set, in he selection of letters, or in the method of indicial differentiation, it is to be understood that all matter herein described or shown in the accompanying drawings is to be interpreted as illustrative and not in a limiting sense.

I claim:

1. A game consisting of a first group of a plurality of tiles and a second group of a plurality of tiles, each of the tiles of the first group bearing two identical letters of the alphabet and each of the tiles of the second group bearing two different letters of the alphabet, each of the tiles of said frist group being provided with indicia means indicating a single direction of play transverse to the direction in which the letters thereon are arranged, each of the tiles of both groups being provided with first means for identifying one of the letters on the tiles as belonging to a first set of letters and second means for identifying the other letter on the tile as belonging to a second set of letters, the first set of letters comprising all of the letters identified by the first identifying means and the second set of letters comprising all of the letters identified by the second identifying means, whereby a series of words can be formed in an indicated direction from the letters of each set.

2. The game of claim 1 in which each of the tiles is generally rectangular and the base of each of the letters thereon extends parallel to he long dimension of the tile.

3. The game of claim 1 in which the first identifying means comprises a first color and the second identifying means comprises a second color.

4. The game of claim 1 in which the first group of tiles includes four tiles which bear, respectively, two letter A's, two letter E's, two letter I's, and two letter T's.

5. The game of claim 1 in which the second group of tiles includes twenty-eight tiles which bear, respectively, the letters A and R, A and X, B and L, C and O, D and A, E and I, E and S, F and N, G and U, H and C, I and B, L and E, L and S, M and H, N and D, N and G, O and E, O and L, O and P, P and N, R and K, R and O, S and T, S and V, T and Z, U and M, W and R, and Y and I.

* * * * *

UNITED STATES PATENT AND TRADEMARK OFFICE

CERTIFICATE OF CORRECTION

PATENT NO. : 4,026,558

DATED : May 31, 1977

INVENTOR(S) : Henry A. Patin

It is certified that error appears in the above-identified patent and that said Letters Patent are hereby corrected as shown below:

Col. 5, line 18 change "frist" to --first--.

Col. 6, line 8 change "he" to --the--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*